United States Patent [19]

Steger

[11] 4,272,201

[45] Jun. 9, 1981

[54] RIBBON SHAPER FOR TYPEWRITER CARTRIDGE

[75] Inventor: Donald J. Steger, Corinth, Ky.

[73] Assignee: International Business Machines Corporation, Armonk, N.Y.

[21] Appl. No.: 122,800

[22] Filed: Feb. 19, 1980

[51] Int. Cl.[3] ..... B41J 35/28

[52] U.S. Cl. ..... 400/208; 400/234; 400/248; 242/76; 242/197

[58] Field of Search ..... 400/208, 234, 248; 242/197, 76, 198, 199, 200

[56] References Cited

U.S. PATENT DOCUMENTS

| | | | |
|---|---|---|---|
| 1,618,590 | 2/1927 | Howell | 242/76 |
| 2,592,090 | 4/1952 | Weaver | 242/76 |
| 3,106,365 | 10/1963 | Karr | 242/76 |
| 3,863,749 | 2/1975 | Perry et al. | 400/208 |
| 4,110,050 | 8/1978 | Wood et al. | 400/248 |

FOREIGN PATENT DOCUMENTS 2820266 11/1978 Fed. Rep. of Germany .

OTHER PUBLICATIONS

IBM Technical Disclosure Bulletin, "Tape Straightener," C. J. Keller, vol. 2, No. 4, Dec. 1959, p. 5.

*Primary Examiner*—Edgar S. Burr
*Assistant Examiner*—C. A. Pearson
*Attorney, Agent, or Firm*—William J. Dick

[57] ABSTRACT

In a ribbon cartridge for retaining and supporting a ribbon in a typewriter, the cartridge comprising spaced apart top and bottom walls and a sidewall joining the top and bottom walls adjacent the periphery thereof to form a chamber. The sidewall of the cartridge is discontinuous at predetermined locations to form at least entrance and exit apertures for the ribbon, and at least a ribbon take up spool is provided in the chamber in communication with the ribbon entrance aperture to take up used ribbon passing through the entrance aperture. A ribbon shaper is provided in the entrance aperture, the ribbon shaper comprising a longitudinally extending base portion extending from the mouth of the entrance aperture inwardly into the chamber, the shaper including an upstanding and longitudinally diverging rib portion on the base portion, the rib portion including a planar upper surface which because of said the divergence is frusto-triangular in plan, the narrower portion of the upper surface lying adjacent the entrance aperture, and the diverging sidewalls on the rib portion extending from the upper surface to the base portion so that ribbon entering the entrance aperture tends to spread and flatten due to pressure exerted against the rib by tension in the ribbon and due to the divergence of the planar upper surface and the divergence of the sidewalls.

14 Claims, 5 Drawing Figures

RIBBON SHAPER FOR TYPEWRITER CARTRIDGE

SUMMARY OF THE INVENTION AND STATE OF THE PRIOR ART

The present invention relates to typewriter ribbon cartridges, and more particularly to a ribbon shaper at the ribbon inlet side of the cartridge such that when a multi-strike or the like film ribbon is utilized as the ribbon for the cartridge, the ribbon is flattened to permit proper transfer of the ribbon upon the ribbon take up spool of the cartridge after typing.

In typewriters employing take up ribbon spools, and more particularly in typewriters employing ribbon cartridges in which is employed multi-strike ribbon, it is desirable that the ribbon being wound upon the take up spool be flat so as to conserve ribbon take up space and to provide for even tension on the ribbon as it passes between the supply roll or spool and the ribbon take up spool, externally of the cartridge, for being struck by the printing element or elements as the case may be.

Multi-strike ribbons employed with typewriters, for example of the single element type such as the IBM SELECTRIC® typewriter, permit of extended ribbon usage and thus long typing usage by the typist without changing ribbons. This type of ribbon is generally referred to as film type ribbon, multi-strike ribbon or the like, a typical example of which is the International Business Machines Corporation Tech III (or T-III) ribbon. A portion of the lateral strength of such a ribbon is the ink contained on the film, which ink forms the material for making imprints upon a print receiving medium such as paper. Accordingly, upon the ribbon being struck a number of times in a small area between the laterally spaced apart but longitudinally extending edges of the ribbon, the ribbon tends to be flimsy, bunch up and if left in that condition tends to wind unevenly upon the take up spool, whether it be contained within a cartridge or whether the ribbon oscillation occurs due to movement of the cartridge itself or due to oscillating guides.

Examples of typical ribbon straighteners which may be found in the prior art are contained in U.S. Pat. Nos. 1,059,522 and 1,780,630 which illustrate convex rollers which serve the purpose of ribbon straightening. However, such curved rollers or surfaces presented by the aforementioned references have been found to be unsuccessful with regard to reliability when the multi-strike ribbon is thin. As presently advised, the most pertinent prior ribbon shaper for typewriters is contained in the guide of the SELECTRIC® typewriter, the guide being such as illustrated in FIG. 1, the guide 1 including a vertically moveable ribbon shaper element 2 having a curved and projecting guide surface 3, the ribbon passing in the direction of the arrow 4 from the typing element towards the take up roll or spool. Such a ribbon shaper was also tried with a cartridge which oscillates for feeding different portions of a multi-strike ribbon intermediate the print element and the typewriter platen, but was proved, as was the other prior art methods alluded to above, unsuccessful with regard to continued reliability for providing an even and uniform take up of the thin multi-strike ribbon upon the take up spool of the cartridge.

A typical cartridge in which the ribbon shaper of the present invention may be employed is best shown in the application of John O. Schaefer, Ser. No. 801,286, filed on May 27, 1977, owned by the assignee of the present invention and incorporated herein by reference. The outer configuration of the cartridge may take the form of the ribbon cartridge illustrated in U.S. Pat. Des. Nos. 253,312 and 253,239 or in co-pending design patent applications Ser. No. 103,265 of David C. Danielson, filed on Dec. 13, 1979, also herein incorporated by reference.

In view of the above, it is the principle object of the present invention to provide a novel ribbon shaper for a cartridge having at least a take up spool, and which will permit a flattening of the ribbon, after typing, for take up on the take up spool.

Other objects and a more complete understanding of the invention may be had with reference to the following specification and claims taken in conjunction with the accompanying drawings, the description of which follows.

DRAWING DESCRIPTION

Figure 1:
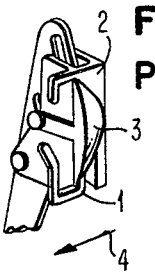
FIG. 1 PRIOR ART
FIG. 1 is a fragmentary perspective view of a typical ribbon shaper employed in the prior art.
Figure 2:
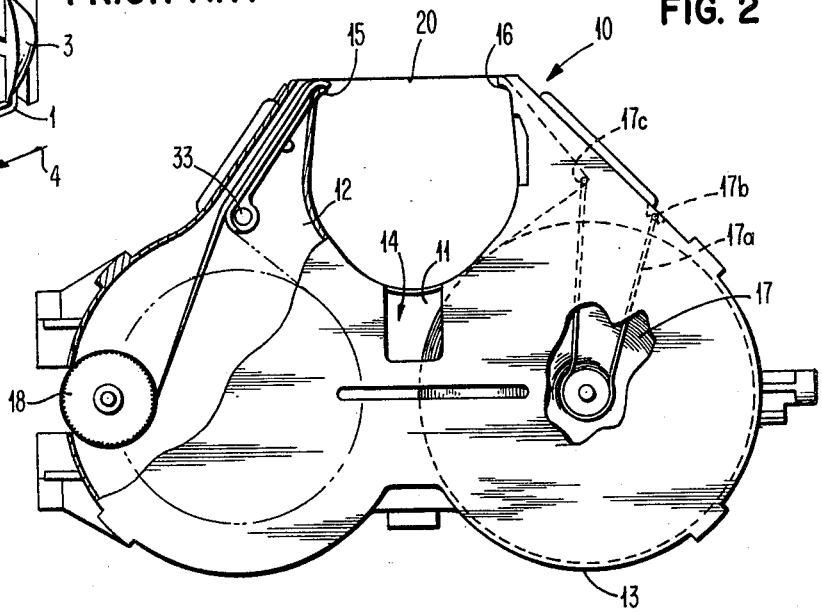
FIG. 2 is a bottom plan view of a typical cartridge employing a ribbon shaper constructed in accordance with the present invention.

Referring now to the drawing, and especially FIG. 2 thereof, a typewriter ribbon cartridge 10, such as illustrated in the aforementioned application of Schaefer and Lenney, (Ser. No. 801,286, filed on May 27, 1977), is illustrated therein. As shown, the ribbon cartridge 10, for retaining and supporting a ribbon in a typewriter, comprises spaced apart top and bottom walls 11 and 12 respectively, and a side wall 13 which joins the top and bottom walls adjacent the periphery thereof to form a chamber 14, the side wall 13 being discontinuous at predetermined locations to form at least entrance and exit apertures 15 and 16 respectively for ribbon 20 extending therebetween from a supply spool 17 to a take up spool 18. Tension on the ribbon 20 intermediate the supply spool 17 and take up spool 18 is conventionally controlled as by take up spool engagement and drive means (not shown) which engages the take up spool 18 for effecting rotation thereof and a secondary means, such as a drag wire or the like **17*a* which is attached at one end to the side wall 13 as at 17*b* and at its opposite terminal end 17*c* engages the ribbon 20. The drag wire 17*a*** is described in IBM Technical Disclosure Bulletin, Vol. 18, No. 4, September 1975, page 1093, entitled "Ribbon Drag Wire".

Figure 3:
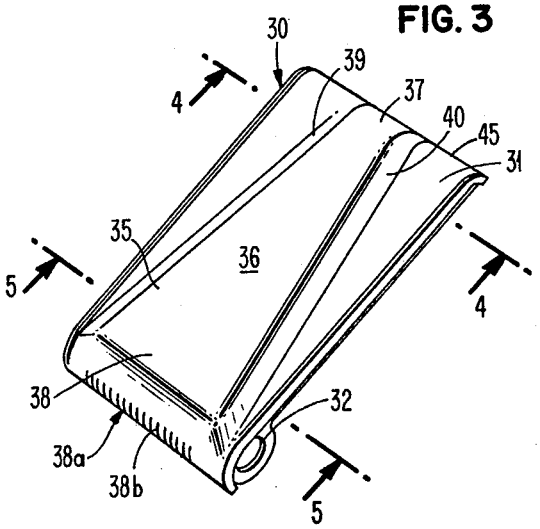
FIG. 3 is an enlarged perspective view of the ribbon shaper illustrated in side elevation in FIG. 2.
Figure 4:
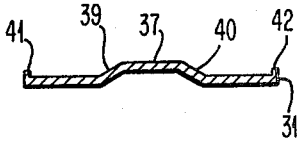
FIG. 4 is a fragmentary sectional view taken along line 4—4 of FIG. 3.
Figure 5:
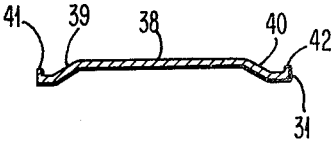
FIG. 5 is a fragmentary sectional view taken along line 5—5 of FIG. 3.

In accordance with the invention, and referring now to FIG. 3, intermediate the take up spool 18 and the entrance aperture 15, preferably at the entrance aperture 15, is disposed a ribbon shaper to effect flattening of the ribbon 20 subsequent to the typing or printing operation of the print element upon the ribbon 20 between the exit and entrance apertures 16 and 15, and prior to the winding of the ribbon on the take up spool 18. To this end, and referring first to FIG. 3, the ribbon shaper 30 comprises a longitudinally extending base portion 31 projecting from the mouth of the entrance aperture 15 (FIG. 2) inwardly into the chamber 14, the shaper 30 being held in position at the entrance aperture as by a ring like aperture 32 projecting from the base portion 31 and connected intermediate the bottom wall 12 and top wall 11 of the cartridge 10 as by a pin or the like 33. Because the typewriter ribbon becomes severely distorted by the beating of the element or elements against the ribbon and the platen of the typewriter, the ribbon shaper 30 includes an upstanding longitudinally diverging rib portion 35 (of substantially uniform height) on the base portion 31, the rib portion including a planar upper surface 36 which because of its divergence is frusto-triangular in plan, the narrower portion 37 lying adjacent the entrance aperture 15 for the ribbon. As illustrated, the narrower portion 37 diverges into a wider trailing portion 38 (FIGS. 3–5), and the planar portion includes diverging side walls 39 and 40 on the rib portion extending from the upper planar surface 36 to the base portion 31 so that ribbon entering the entrance aperture 15 tends to spread and flatten because of the pressure exerted against the rib by tension in the ribbon and due to the divergence of the planar upper surface 36 of the rib and the divergence of the side walls 39 and 40 respectively.

Typically the hammering of the print element against the multi-strike ribbon 20 intermediate the exit aperture 16 and the ribbon aperture 15 takes the strength out of the ribbon in the lateral direction tending to cause the ribbon to be very flimsy in the center portion thereof. Thus the multi-strike ribbon does not tend to respond like a conventional single flat belt on a crown pulley. It has been observed that typically the film ribbon responds more like a pair of flat belts on a crown pulley surface, each trying to move to the center of the crown since the typed on ribbon central portion of the ribbon 20 offers virtually no resistance. Without the ribbon shaper 30 of the present invention, this type of action on the ribbon consistently produces folding or lapping of the ribbon. In the present instance, the ribbon shaper of the present invention overcomes this problem by controlling and continually modifying the ribbon shape from the entrance aperture 15 of the cartridge to the take up spool 18. Thus the lateral edges (longitudinally extending edges) of the ribbon 20 tend to move outwardly from the leading edge of the planar surface 37 towards the trailing edge causing the ribbon to spread.

Although the top wall 11 and bottom wall 12 of the cartridge may serve as side walls for the spread of the ribbon, it is preferable that the shaper include longitudinally extending laterally spaced apart lip portions 41 and 42 respectively which tend to constrain the ribbon to the shaper in the event that any part of it moves or tends to move off the shaper 30. In this connection, it is preferable that the ribbon shaper 30 be composed of a low friction material with respect to the ribbon, polyethylene being one such preferred material.

With the ribbon shaper 30 in the position illustrated in FIG. 2, i.e., with the leading edge 37 at the entrance aperture 15 of the cartridge 10, it is preferred that the leading edge 45 of the shaper be gently and smoothly rounded for non-snag guidance of the ribbon onto the base 31 and rib portion 35. Moreover, to permit smooth separation (non-sticking) of the ribbon 20 as it exits past the trailing portion 38 towards the take up spool 18, it is preferred that the trailing edge **38*a* be gently rounded with longitudinally extending gentle serrations 38*b*** thereon.

Thus the ribbon shaper of the present invention tends to spread the flimsy portion of the ribbon because of the diverging side walls and the longitudinal divergence of the rib portion, permitting used ribbon to enter onto the take up spool 18 in a substantially flat configuration.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. In a ribbon cartridge for retaining and supporting a ribbon in a typewriter, said cartridge comprising spaced apart top and bottom walls and a side wall joining said top and bottom wall adjacent the periphery thereof to form a chamber, said side wall being discontinuous at predetermined locations to form at least entrance and exit apertures for a ribbon, and at least ribbon take up spool means in said chamber in communication with said ribbon entrance aperture; an improvement comprising: a ribbon shaper disposed intermediate said entrance aperture and said take up spool, said ribbon shaper comprising a longitudinally extending base portion extending inwardly into said chamber; an upstanding longitudinally diverging rib portion on the base portion, said rib portion including a planar upper surface which because of said divergence is frusto-triangular in plan, the narrower portion of said upper surface being closer to said entrance aperture than the wider portion; and diverging side walls on said rib portion extending from said upper surface to said base portion whereby ribbon entering said entrance aperture tends to spread due to the pressure exerted against said rib and due to the divergence of said planar upper surface and the divergence of said side walls.

2. In a ribbon cartridge in accordance with claim 1 including laterally spaced apart lip portions longitudinally extending along the lateral terminal edges of said base portion.

3. In a ribbon cartridge in accordance with claim 1 or 2 including serrations at the trailing edge of said shaper.

4. In a ribbon cartridge in accordance with claim 1 wherein said rib is of substantially a uniform height.

5. In a ribbon cartridge for retaining and supporting a ribbon in a typewriter, said cartridge comprising spaced apart top and bottom walls and a side wall joining said top and bottom walls adjacent the periphery thereof to form a chamber, said side wall being discontinuous at predetermined locations to form at least entrance and exit apertures for ribbon, and at least a ribbon take up spools means in said chamber communication with said ribbon entrance aperture to maintain tension on ribbon passing through said entrance aperture; an improvement comprising: a ribbon shaper in said entrance aperture, said ribbon shaper comprising a longitudinally extending base portion extending from the mouth of said entrance aperture inwardly into said chamber, an upstanding longitudinally diverging rib portion on said base portion, said rib portion including a planar upper surface which because of said divergence is frusto-triangular in plan, the narrower portion lying adjacent said entrance aperture, and diverging side walls on said rib portion extending from said upper planar surface to said base portion whereby ribbon entering said entrance aperture tends to spread and flatten due to the pressure exerted against said rib by said tension in said ribbon and due to said divergence of said planar upper surface and the divergence of said side walls.

6. In a ribbon cartridge in accordance with claim 5 including means to connect said ribbon shaper to said cartridge.

7. In a ribbon cartridge in accordance with claim 5 or 6 including a smoothly rounded leading edge on said ribbon shaper.

8. In a ribbon cartridge in accordance with claim 7 including serrations at the trailing edge of said shaper.

9. In a ribbon cartridge in accordance with claim 7 including longitudinally extending laterally spaced apart, upstanding lip portions on said base portion.

10. A ribbon cartridge for retaining and supporting a ribbon in a typewriter, said cartridge comprising spaced apart top and bottom walls and a side wall joining said top and bottom wall adjacent the periphery thereof to form a chamber, said sidewall being discontinuous at predetermined locations to form at least entrance and exit apertures for said ribbon, a ribbon takeup spool means in said chamber in communication with said ribbon entrance aperture, and a supply spool means in said chamber in communication with said ribbon exit aperture; a ribbon shaper disposed in the path of said ribbon intermediate said entrance aperture and said takeup spool, said ribbon shaper comprising a longitudinally extending base portion projecting inwardly into said chamber; an upstanding longitudinally diverging rib portion on the base portion, said rib portion including a planar upper surface which because of said divergence is frusto-triangular in plan, the narrower portion of said upper surface being closer to said entrance aperture than the wider portion; and diverging sidewalls on said rib portion extending from said upper surface to said base portion whereby ribbon entering said entrance aperture tends to spread due to pressure exerted against said rib by said ribbon and due to the divergence of said planar upper surface and the divergence of said sidewalls.

11. A ribbon cartridge in accordance with claim 10 wherein said typewriter ribbon comprises a multi-strike ribbon.

12. A ribbon cartridge in accordance with claim 10 or 11 wherein said ribbon shaper includes a gently rounded leading edge portion disposed in said ribbon entrance aperture.

13. A ribbon cartridge in accordance with claim 12 wherein said rib portion has a substantially uniform height.

14. A ribbon cartridge in accordance with claim 13 wherein said base portion includes a pair of spaced apart longitudinally extending upstanding lip portions on said base portion and at the lateral extremities thereof.

* * * * *